US010341788B2

(12) United States Patent
Henriksen

(10) Patent No.: US 10,341,788 B2
(45) Date of Patent: Jul. 2, 2019

(54) HEARING AID BATTERY DRAWER WITH A THIN FILM

(71) Applicant: Oticon A/S, Smørum (DK)

(72) Inventor: Poul Henriksen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/669,671

(22) Filed: Aug. 4, 2017

(65) Prior Publication Data

US 2018/0041851 A1 Feb. 8, 2018

(30) Foreign Application Priority Data

Aug. 5, 2016 (EP) ..... 16183001

(51) Int. Cl.
*H04R 25/00* (2006.01)

(52) U.S. Cl.
CPC ..... *H04R 25/602* (2013.01); *H04R 25/556* (2013.01); *H04R 25/65* (2013.01); *H04R 2225/31* (2013.01); *H04R 2225/33* (2013.01)

(58) Field of Classification Search
CPC .... H04R 25/556; H04R 25/60; H04R 25/602; H04R 25/65; H04R 2225/023; H04R 2225/025; H04R 2225/31; H04R 2225/61
USPC ..... 381/60, 322, 323, 324, 328, 330
See application file for complete search history.

(56) References Cited

U.S. PATENT DOCUMENTS 4,941,180 A * 7/1990 Buettner ..... H04R 25/602 381/323
5,687,242 A 11/1997 Iburg
6,144,749 A 11/2000 Fideler
7,443,992 B2 * 10/2008 Fideler ..... H04R 25/604 381/322

FOREIGN PATENT DOCUMENTS

DE 10 2011 081 958 A1 5/2012
JP 53-135205 A 11/1978
WO WO 2014/113044 A1 7/2014

* cited by examiner

*Primary Examiner* — Huyen D Le
(74) *Attorney, Agent, or Firm* — Birch, Stewart, Kolasch & Birch, LLP

(57) ABSTRACT

A hearing aid comprising a housing configured to receive a battery is disclosed. The housing comprises a battery drawer configured to receive the battery, wherein the battery drawer comprises a cover and a surrounding structure configured to at least partly surround the battery. The cover is attached to said surrounding structure and at least a part of the battery drawer is slidably attached to the housing.

21 Claims, 5 Drawing Sheets

Fig. 2A
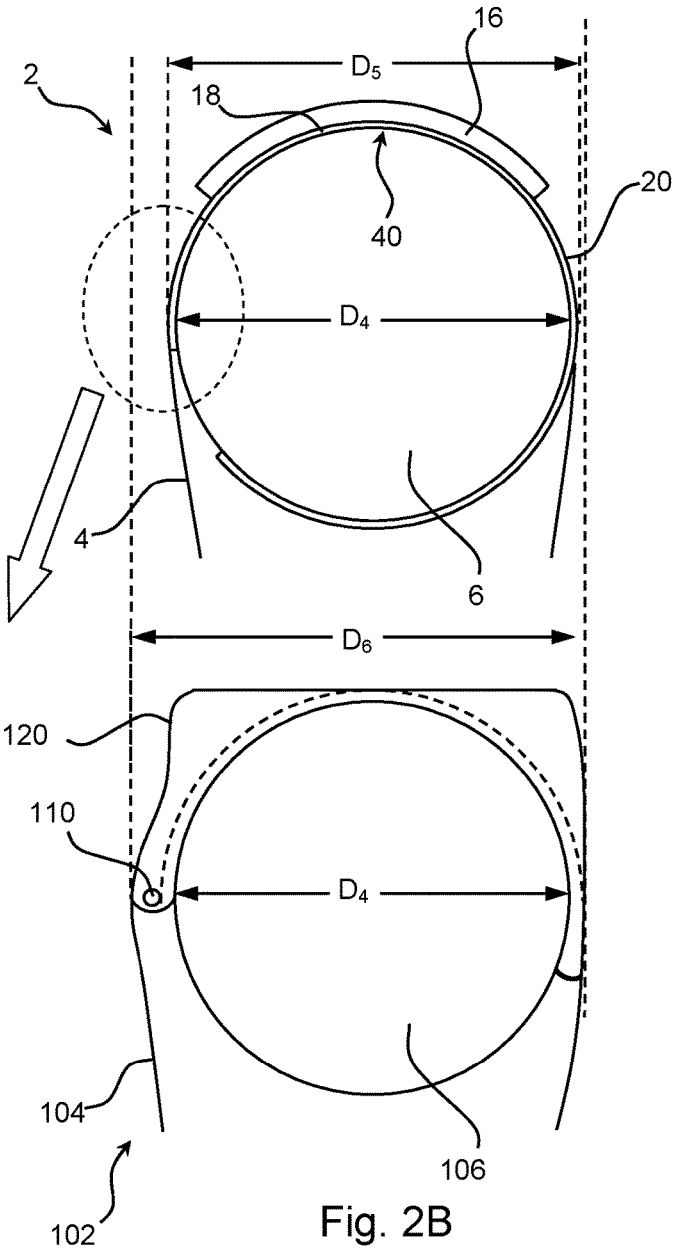
Fig. 2C
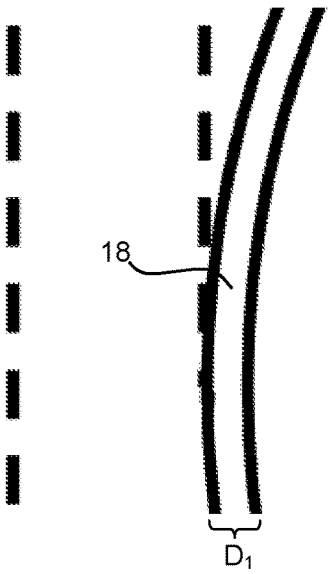
Fig. 2B

Fig. 3A
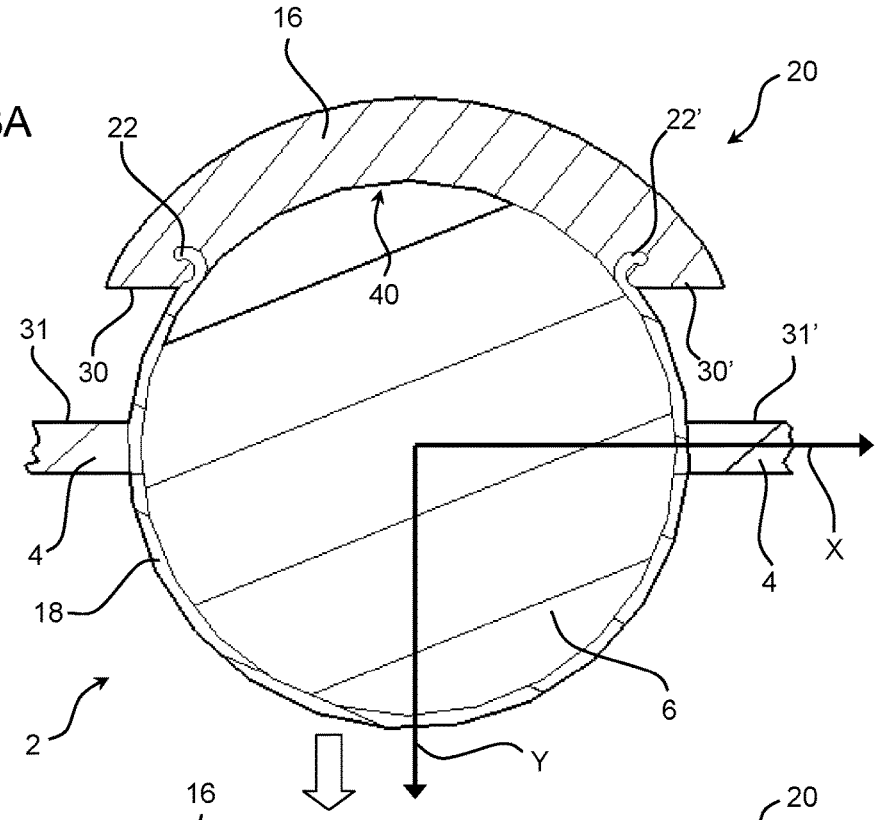
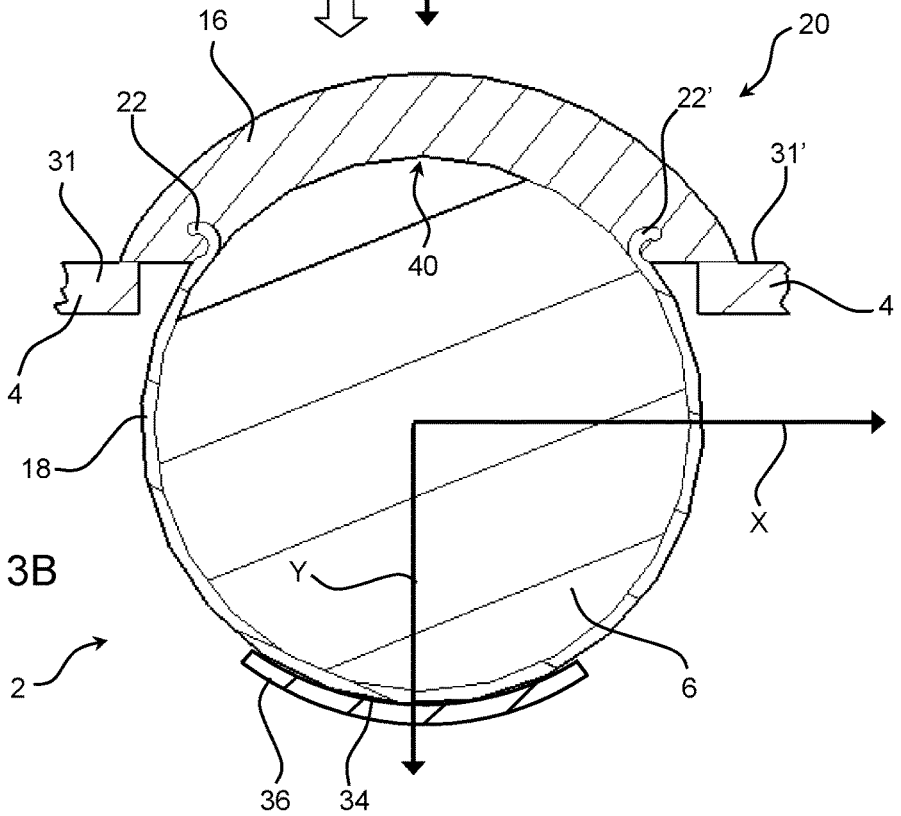
Fig. 3B

HEARING AID BATTERY DRAWER WITH A THIN FILM

FIELD

The present disclosure relates to a hearing device having a battery drawer. More particularly, the disclosure relates to a hearing device, such as a hearing aid having a battery drawer of reduced size.

BACKGROUND

The outer dimensions of hearing devices intended to be situated in the ear canal of a user are restricted by the geometry of the ear canal. Accordingly, the outer dimensions of the hearing device are of essential importance. It is important to ensure that none of the hearing device components introduce a risk of damaging the walls of the ear canal.

Therefore, there is an increasing focus on the design of hearing device housings. Several attempts have been made to minimise the outer dimension of the components of the housing. One component that takes up a significant amount of space is the battery and the battery drawer.

Normally, the battery drawer is hinged to the housing in such a manner that e.g. in completely in the canal (CIC) and/or In-the-ear (ITE) style hearing aids a faceplate is arranged to guide the sliding in the form of a rotational movement of the battery drawer. In other styles of hearing aids, such as the behind-the-ear (BTE) styles the battery drawer also takes up a substantial amount of the housing of the hearing aid, due to the hinged mechanical connection providing the possibility of opening the battery drawer in a rotational manner in relation to the housing for insertion and removing the battery. In any style of hearing aid, the hinge connection, which allows a rotational movement, takes up a significantly amount of space. Accordingly, the use of a hinge is a limiting factor when designing small hearing devices.

Moreover, in order to provide a hearing device that is more discreet (more difficult to see from the outside) it would be beneficial to reduce the size of the hearing device. Therefore, there is a need to provide a solution that allows for providing a hearing device (e.g. a hearing aid) of reduced size. The present disclosure provides an alternative to the prior art hearing aids.

SUMMARY

Accordingly, a hearing device, such as a hearing aid having a reduced sized battery drawer is disclosed. The hearing aid according to embodiments of the disclosure comprises a housing having an outer structure and a battery drawer configured to receive a battery and to be inserted into the housing from the outer structure of the housing. In more detail, the battery drawer comprises a cover and a surrounding structure where the surrounding structure is attached to the cover. Furthermore, the surrounding structure is configured to at least partly surround the battery and the surrounding structure is configured as a film member made in a flexible and/or bendable material, wherein the battery drawer is configured to receive the battery in said surrounding structure. In this way, the battery drawer is configured so that said battery drawer upon a user of the hearing aid gripping and pulling or pushing the cover, the battery drawer is configured to be inserted into or taken out from the housing, wherein the direction of insertion of the battery drawer is substantially perpendicular to said surface of said outer structure of said housing.

Accordingly, the battery drawer comprises a cover with an integrated surrounding structure intended to receive the battery. That is, when the battery is inserted into the surrounding structure formed as a flexible film member, the entire battery drawer, with cover, surrounding structure and battery, may be inserted into the housing in an opening thereof intended to receive the battery drawer. Similarly, the battery drawer is removed from the housing by gripping and pulling in the cover, whereby the pull in the cover brings out the surrounding structure with the battery placed therein. Accordingly, by configuring the battery drawer with a surrounding structure made as a film member attached to the cover, the normally used hinge structure intended to allow the battery drawer to rotate is avoided. In this way, the material thickness which is usually needed to allow the configuration of a hinge structure, is avoided.

Thus with the solution according to the disclosure, it is possible to provide a battery drawer having a surrounding structure of smaller size than the prior art solutions, since the regularly used hinge connection allowing rotation is removed. Instead, the reduced material thickness of the construction of the battery drawer allows the battery drawer to be inserted into the housing of the hearing aid in a direction perpendicular to an outer surface structure of the housing, rather than performing a rotation of the battery drawer.

The housing may have any geometry suitable for receiving a battery.

The parts of battery drawer may be produced in any suitable material, including plastic, metal or another material. However, in order to allow a sufficient reduction of the material thickness of the battery drawer, it is preferred that the surrounding structure is at least produced in a thin film material which have flexible and bendable properties. The material may be a foil material such as a thin sheet. The cover of the battery drawer could be produced in plastic or any other suitable material.

The surrounding structure of the battery drawer may be configured to at least partly surround the battery. That is, the surrounding structure configured as a film member may comprise two opposing plane sides, which two opposing plane sides of the film member are configured to at least partly surround the battery on at least two opposing sides of the battery. Furthermore, the two opposing sides of the film member may be distanced by a further cylindrical side configured to surround at least a part of the cylindrical periphery of the battery, such that the film member receives the battery in a cavity formed by the two plane sides and said cylindrical side of said film member. Accordingly, the cover and the surrounding structure may surround a small percentage of the battery or a larger percentage of the battery depending on the extends of the plane sides of the film member. That is, in an embodiment, the film member may cover substantially half of the at least two parallel opposing sides of the battery. It should be noted that the mentioned two opposing sides of the battery should be construed as the two plane surfaces of the battery, i.e. where the plus pole sign normally is configured on a battery. Accordingly, the battery is substantially enclosed by the surrounding structure by two opposing side of the film member on two opposing sides of the battery, and around the circular periphery of the battery, i.e. the substantially curved side of the battery.

In an embodiment, the battery drawer may be configured to be inserted in the housing in a slidable manner. That is, by gripping the cover, a user of the hearing aid slides the battery drawer into the housing structure configured to receive the battery drawer.

Accordingly, by the term slidably attached to the housing is meant that the battery drawer is attached to the housing in a manner, in which the battery drawer can be slid between at least a first position removed position and a second inserted position, preferably in a direction perpendicular to the outer surface structure of the housing.

According to an aspect of the disclosure, the battery drawer or at least a part of the battery drawer is arranged to be moved basically radially relative to the battery.

The hearing aid according to the disclosure can be made with a battery drawer without a hinge structure. In prior art hearing aids (including prior art hearing devices), the use of a hinge structure for operating the battery drawer of the hearing aid requires a large material thickness in order to mount the hinge of the battery drawer to the housing of the hearing aid. Accordingly, the use of a hinged structure is a limiting factor when reducing the outer dimensions of the housing of the hearing aid. Therefore, the size of the hearing aid according to the disclosure can be reduced compared to the prior art hearing aids that comprise a battery drawer with a hinge structure.

As generally disclosed, the surrounding structure is a film member made in a flexible and/or bendable material. Hereby, it is possible to provide a material having mechanical properties that makes it possible to form/shape the surrounding structure and hereby move the battery drawer with a battery from one removed position to another inserted position (and back) in an easy manner. Accordingly, it is possible to provide a hearing aid without any mechanical structures, such as a hinge structure, whereby the material thickness of the material needed for the battery drawer to connect with the housing is reduced.

As will become apparent, the battery drawer comprises a cover attached to the surrounding structure. In more detail, the cover may form the closing portion of the battery drawer. The cover may constitute a structure that is used for fixation of the surrounding structure. Accordingly, the cover can be used as a user interface that can be operated by the user in order to move the battery drawer.

It may be an advantage that the cover is attached to the outside structure of a film member or to one or more attachment portions provided at the film member.

In more detail, the cover may comprise at least one engagement structure configured to be brought into contact with at least one structure of the housing, wherein the surrounding structure is attached to the cover by means of a first attachment member and/or a second attachment member. Hereby, the engagement structure(s) can secure that the cover is positioned in a desired position relative to the housing. The engagement structure(s) may be configured to bear against the outside structure of the housing, hereby positioning the cover in a predefined position relative to the housing.

In more detail, the at least one engagement structure of the cover may be configured as a plate-shaped engagement structure, which upon insertion of the battery drawer into the housing is brought into engaging contact with parts of the outer structures of the housing.

The cover may be attached to the distal portion of the surrounding structure. By the distal portion of the surrounding structure is meant the portion of the surrounding structure that faces towards the outer periphery of the battery drawer. Accordingly, the distal portion of the surrounding structure is the portion of the surrounding structure that can be accessed from outside the battery drawer.

According to yet another aspect of the disclosure, the cover is configured to be arranged outside the housing when the battery is inserted into the housing.

Hereby, the cover may be used as a closing structure and handle structure for opening and closing the battery drawer. This function may be essential during insertion and removal of a battery, where the cover is gripped by a user to allow a pull or push on the cover, whereby the battery drawer may be removed or inserted, respectively.

In an embodiment, the cover comprises an inner structure shaped to fit at least a portion of the outer structure of the battery wherein the surrounding structure extends from said cover around an outer contour of said battery. Accordingly, the cover may at an inner side preferably have a curved shaped fitting the curved contour of a regular hearing aid battery.

In other words, the inner structure of the cover is shaped to fit a section of a cylindrically shaped battery, whereby the cover is formed to bear against the battery. Accordingly, the size of the battery drawer can be minimized and the battery can be held in place by using the cover. Furthermore, the shape of inner structure of the cover and the surrounding structure extending from the cover around a contour of the battery allows the battery to be kept in a fixed position. Further, the size of the cover can be minimised if a cylindrically shaped battery is used.

In an embodiment, the surrounding structure is attached to the cover by means of a first attachment member.

In more detail, the configuration of the cover may be such that said engagement structure of the cover is arranged parallel with an outer surface of the housing structure, ensuring a substantially well-aligned transition between the surface of the outer structure of the housing and the cover. On an inner side of the cover, the cover may be configured with engagement groves which are arranged to receive at least said first attachment member of the film. Hereby, it is possible to attach the surrounding structure to the cover in an easy and reliable manner. The attachment member may have any suitable size and geometry. The attachment member may be provided as a portion of the surrounding structure e.g. a bent portion of the surrounding structure.

It may be an advantage that a corresponding receiving structure (configured to receive the attachment member) is provided in the cover. That is, the bend portion of the surrounding structure may preferably be received in corresponding grooves in the cover, so as to ensure a secure attachment between the cover and the surround structure, which allows the surrounding structure to be pulled out of the hearing aid housing, when pulling on the cover.

In an embodiment, the surrounding structure is at least partly connected to the housing and/or to a structure arranged in the housing by means of a third attachment member. Hereby, it is possible to provide a firm and secure attachment of the cover and the surrounding structure to the housing. The third attachment member may have any suitable size and geometry. Further, the third attachment member may be provided as a portion of the surrounding structure e.g. a bent portion of the surrounding structure or as a magnet material configured to connect with a corresponding magnet material arranged in the housing structure.

The third attachment member may be arranged in a non-zero distance from the cover.

The third attachment member may be arranged in a non-zero distance along a longitudinal axis of said cover or of a transverse direction perpendicular to the longitudinal axis from said cover.

Hereby, it is possible to attach the surrounding structure to the housing in a manner in which the surrounding structure can be removed from the housing in an easy manner upon pulling the cover of the battery drawer.

In an embodiment, the width of the battery drawer corresponds to the sum of the diameter of the battery and the thickness of the surrounding structure, which ensures a reduced size of the housing compared to the prior art.

In practice it is possible to reduce the width of the battery drawer and thus the size of the housing with at least 0.5-2 mm, such as 0.5 mm, 0.8 mm, 1.0 mm, 1.2 mm, 1.5 mm, 1.8 mm, 2.0 mm, 2.5 mm, 3.0 mm, 3.5 mm or 4 mm.

It is possible to apply a surrounding structure made in a film material of any suitable thickness. The thickness of the film material (i.e. the surrounding structure) may be 0-300 μm, such as 50-200, like approximately 100 μm.

In an embodiment, the width of the battery drawer corresponds to the sum of the diameter of the battery and two times the thickness of the surrounding structure, which substantially corresponds to the surrounding structure having equal amount of material surrounding the battery contour on the sides of the battery.

According to a further aspect of the disclosure, the battery drawer comprises a spring member or a resilient member configured to press against the battery, when the battery is arranged in the battery drawer, wherein the spring member or the resilient member is configured to maintain the battery in a fixed position with respect to the battery drawer.

Hereby, the battery can be held in place by using the spring member or the resilient member. The spring member or the resilient member may have any suitable size and form. It may be an advantage that the spring member or the resilient member is small-sized in order to minimize the space required for the spring member or the resilient member.

As already disclosed throughout the disclosure, it is apparent that the battery drawer according to the invention removes the need of a hinge structure in the battery drawer, why the battery drawer may be attached to the housing without the use of such hinge structure, whereby it is possible to reduce the material thickness and thus the size of the battery drawer.

According to another aspect of the disclosure, at least a section of the surrounding structure comprises a magnetic material.

Hereby, it is possible to attach the surrounding structure to the battery or an internal part of the hosing by applying magnetic attraction. Accordingly, at reliable attachment of the surrounding structure to the battery or an internal part of the housing can be achieved. It is also possible to apply magnetic attraction to fix the surrounding structure to the housing or a structure within the housing.

In an embodiment, at least a section of the surrounding structure comprises an electrically conducting material, whereby
it is possible to provide an electrical connection between the battery and another structure of the device by simple means. The electrically conducting material may be integrated in the surrounding structure in any suitable way.

In another embodiment, at least a section of the surrounding structure is made in an electrically conducting material, whereby the electrically conducting material can be used to electrically connect the battery with another structure. Accordingly, a simple construction can be provided.

In addition, and in line with the above identified embodiment, at least a section of the surrounding structure comprises an electrically non-conducting material, whereby it is possible to prevent at least a section of the surrounding structure from establishing an electrical connection to the battery. Furthermore, it is possible to electrically isolate at least a section of the surrounding structure.

Similarly, it is contemplated that at least a section of the surrounding structure may be made in an electrically non-conducting material, whereby it is possible to electrically isolate at least a section of the surrounding structure.

In more detail, the surrounding structure may be configured such that at least a first section of the surrounding structure is made in an electrically non-conducting material and wherein at least a second section of the surrounding structure is made in an electrically conducting material. Hereby, it is possible to establish an electrical connection having a predefined structure in order to electrically connect the battery to one or more structures of the device.

According to another aspect of the disclosure, the hearing device is an in-the-ear (ITE) hearing device or a completely-in-canal (CIC) hearing device or an invisible in the canal (IIC) hearing device or an in-the-canal (ITC) hearing device. It may be an advantage to reduce the size of these types of hearing devices in order to provide a more discreet hearing device that is difficult to see from the outside.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

FIG. 2A shows a schematic view of a hearing device according to an embodiment of the disclosure;

FIG. 2B shows a schematic view of a prior art hearing device;

FIG. 2C shows a close-up view of a section of the hearing device shown in FIG. 2A;

FIG. 3A shows a schematic cross-sectional view of a hearing device according to an embodiment of the disclosure in a first configuration;

FIG. 3B shows a schematic cross-sectional view of the hearing device shown in FIG. 3A in a second configuration;

DETAILED DESCRIPTION

Figure 1A:
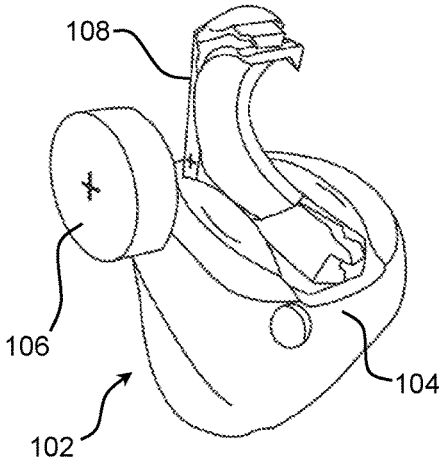
Prior Art Fig. 1A
FIG. 1A shows a schematic perspective view of a prior art hearing device.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components. Depending upon particular application, design constraints or other reasons, these elements may be implemented using electronic hardware, computer programs, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of the middle ear of the user or electric signals transferred directly or indirectly to the cochlear nerve and/or to the auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in an In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of the following: remote controls, remote microphones, audio gateway devices, mobile phones, public-address systems, car audio systems or music players or a combination thereof.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Now referring to FIG. 1A, which illustrates a schematic perspective view of a prior art hearing device 102 comprising a housing 104 and a battery drawer having a lid 108. The battery drawer is configured to receive a battery 106 (arranged next to the hearing device 102). It should be noted that FIG. 1A illustrates a completely-in-the-canal (CIC)-style hearing aid, and this style hearing aid is as such only used as an example for explaining the features according to aspects and embodiments of the disclosure. Thus, it should be understood that e.g. a BTE-style hearing aid could similarly be configured with the embodiments described herein.

Figure 1B:
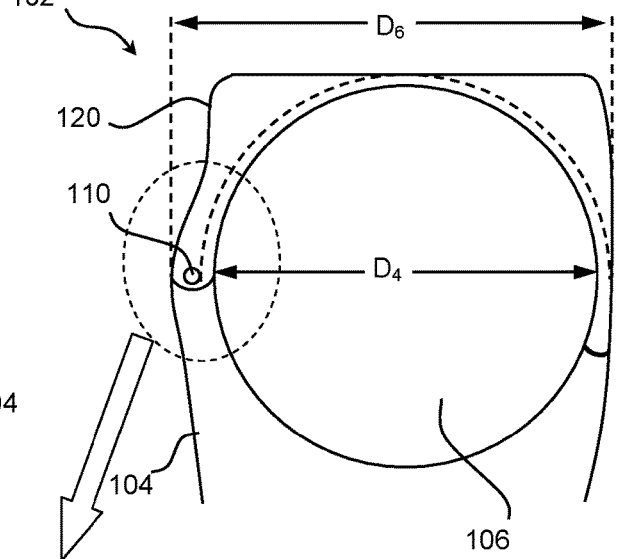
FIG. 1B shows a schematic side view of a prior art hearing device.

FIG. 1B illustrates a schematic side view of a prior art hearing device 102 corresponding to the one shown in FIG. 1A. The hearing device 102 comprises a housing 104 having a battery drawer 120 that is rotatable attached to the housing 104 by means of a hinge assembly comprising a pin 110. A cylindrical battery 106 having a width $D_4$ is received in the battery drawer 120 and is configured to power-up the hearing device 102. The width $D_6$ of the battery drawer 120 is indicated in FIG. 1B.

Figure 1C:
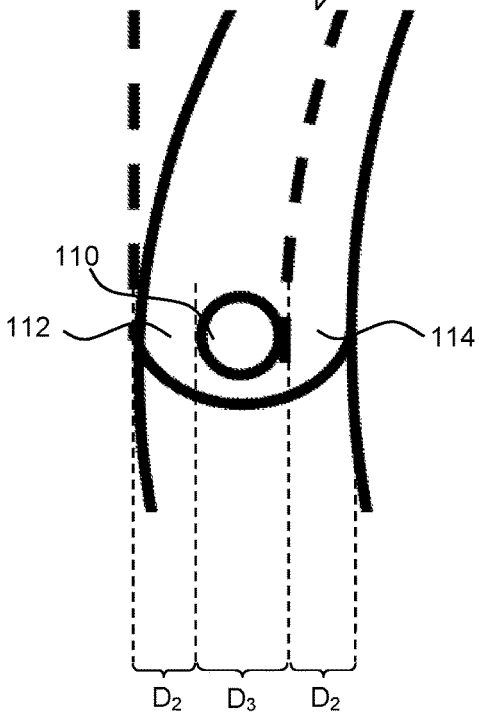
FIG. 1C shows a close-up view of a section of the hearing device shown in FIG. 1B.

FIG. 1C illustrates a close-up view of a section of the hearing device 102 shown in FIG. 1B. It can be seen that the pin 110 is arranged in a structure having a first joint surrounding structure 112 and a second joint surrounding structure 114.

The pin 110 and the surrounding structures 112, 114 constitute a hinge joint enabling the battery drawer 120 to be opened and closed by rotation. The width $D_3$ of the pin 110 is indicated in FIG. 1C. Furthermore, the widths $D_2$ of the first joint surrounding structure 112 and the second joint surrounding structure 114 are indicated in FIG. 1C. It can be seen that the widths $D_2$ of the first joint surrounding structure 112 and the second joint surrounding structure 114 are slightly smaller than the width $D_3$ of the pin 110.

FIG. 2A illustrates a schematic view of a hearing device, such as a hearing aid 2 according to an embodiment of the disclosure. The hearing device 2 comprises a battery drawer 20 that has received a battery 6 of cylindrical geometry. The battery drawer comprises a surrounding structure, preferably provided as a film member 18 that at least partly surrounds the cylindrical periphery of the battery 6. It should be noted that the film member 18 does not comprise any joint surrounding structures which provides additional thickness to the battery drawer. Accordingly, it is possible to reduce the size of the hearing device 2, compared to a regularly hinged battery drawer as shown in FIG. 2B and to be explained in more detail in the following.

In more detail in FIG. 3A, the hearing aid according to embodiments of the invention comprises a housing 4 having an outer structure 31, 31' and a battery drawer 20 configured to receive a battery 6 and to be inserted into said housing 4 from said outer structure 31, 31'. The battery drawer 20 furthermore comprises a cover 16 and a surrounding structure 18 (also referred to as a film member), wherein the surrounding structure 18 is attached to the cover 16. As can be seen in the Figures, the surrounding is configured to at least partly surround said battery, and said surrounding structure 18 is configured as a film member made in a flexible and/or bendable material, to allow the surrounding structure to surround the substantially cylindrical battery.

In use, said battery drawer may be inserted to and removed from the housing 4 as illustrated in FIGS. 3A and 3B. That is, the battery drawer is configured to receive a battery in the surrounding structure of the battery drawer, such that a user of the hearing aid upon gripping and pulling or pushing the cover, the battery drawer is configured to be inserted or taken out from the housing. The direction of insertion and/or removal of the battery drawer is substantially perpendicular to a surface of the outer structures 31, 31' of the housing, as illustrated in FIGS. 3A and 3B by the line Y. In this way, the battery drawer with the surrounding structure holding the battery and the cover may be moved from a removed position illustrated in FIG. 3A to an inserted position illustrated in FIG. 3B. The construction of the cover and surrounding structure allowing this perpendicular movement and attachment to the housing will become more apparent in the following.

Referring back to FIG. 2A, the cover 16 of the battery drawer furthermore comprises an inner structure 40 shaped to fit at least a portion of the outer structure of the battery 6. The inner structure 40 has a circular arced geometry configured to bear against the battery 6. The construction of the cover 16 will be described in more detail in relation to FIGS. 3A to 5B.

The width $D_4$ of the battery 6 as well as the width $D_5$ of the battery drawer is indicated in FIG. 2A. As viewed in FIG. 2A the width $D_5$ of the battery drawer corresponds to the width of the housing 4, which in comparison with the width of a prior art hearing aid with a hinged battery door is substantially smaller. This becomes more apparent when comparing FIG. 2B, which illustrates a schematic view of a prior art hearing device 2 corresponding to the one shown in FIG. 1B, with the solution according to the disclosure and illustrated in FIG. 2B. As can be seen, the hearing device 2 is arranged below the hearing device shown in FIG. 2A in order to compare the width of the battery drawers 20, 120 and the housings 4, 104.

The hearing device 102 shown in FIG. 2B comprises a housing 104 having a larger width $D_6$ than the hearing device 2 shown in FIG. 2A. A battery 106 of a similar width $D_4$ as the one shown in FIG. 2A has been inserted into the hearing device 102 shown in FIG. 2B. The hearing device 102 shown in FIG. 2B comprises a housing 104 having a battery drawer 120 rotatably attached to the housing 104 by means of a hinge assembly comprising a pin 110. The width $D_6$ of the battery drawer 120 is indicated in FIG. 2B.

It can be seen that the width $D_6$ of the battery drawer 120 in FIG. 2B is larger than the width $D_5$ of the battery drawer 20 shown in FIG. 2A. Accordingly, the hearing device 2 shown in FIG. 2A has a smaller battery drawer 20 than the prior art hearing device 102 shown in FIG. 2B, whereby a reduction in material thickness is achieved by using a surrounding structure made as a film member and substantially providing a cavity to hold the battery in the battery drawer.

Thus, instead of rotating the battery into position in the hearing aid housing, the battery drawer according to the invention and as previously described is slide into the housing in a non-rotatable manner, but instead along a direction being perpendicular to the surface of the outer structure of the hearing aid housing.

FIG. 2C illustrates a close-up view of a section of the hearing device 2 shown in FIG. 2A. The width $D_1$ of the film member 18 is indicated in FIG. 2C. It can be seen that the width $D_1$ is significantly smaller than the width (thickness) of the surrounding structures surrounding the hinge joint of the battery drawer shown in FIG. 2B.

Thus, it is clear that the provision of a film member 18, such as preferably a thin-film member used as surrounding structure to the cylindrical periphery of the battery 6 limits material needed to provide a battery drawer which can open and close to allow for insertion and removal of a battery in a hearing aid housing 4.

By the term "film member" should be understood that this is a material which in itself is a very thin structure, so that it obtains flexible and/or bendable properties. Thus, it is understood that any preferably non-bendable material could be used for the purpose as a film member, as long as the thickness of the material allows the material to bend when a minor force is applied.

Figure 4B:
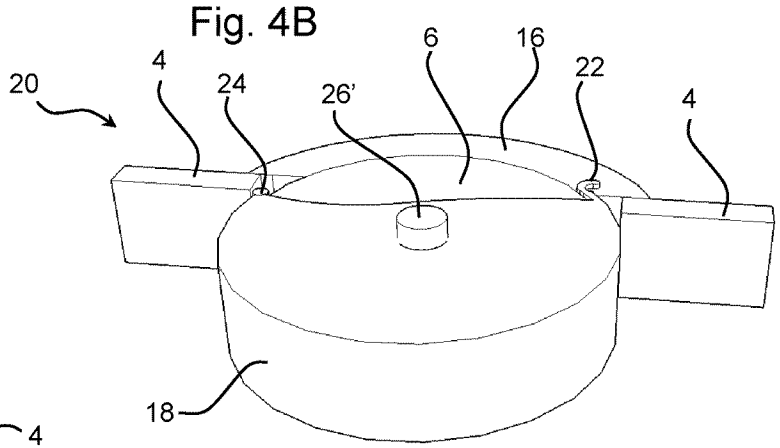
FIG. 4B shows a perspective bottom view of the hearing aid shown in FIG. 4A.

Furthermore, the film member may comprise two opposing plane sides, which two opposing plane sides of the film member are configured to at least partly surround the battery on at least two opposing sides of the battery, which is illustrated in the embodiment of FIG. 4B. In this embodiment, the two opposing sides of the film member is distanced by a further cylindrical side configured to surround at least a part of the cylindrical periphery of said battery such that said film member receives said battery in a cavity formed by the two plane sides and said cylindrical side of said film member.

In other embodiments, it may be contemplated that the film member merely comprises the cylindrical side to receive the battery therein.

Referring now to FIG. 3A, a schematic cross-sectional view of a hearing device 2 according to an embodiment of the disclosure in a first configuration is illustrated. The hearing device 2 comprises a housing 4 and a battery drawer 20 comprising a film member 18 attached to a cover 16 as previously described. In more detail, the film member 18 is attached to the cover 16 by means of a first attachment member 22 and a second attachment member 22'. The film member 18 is wrapped around the battery 6 having a circular cross-sectional area. Hereby, the film member 18 surrounds the battery 6. In more detail, the configuration of the cover 16 is as illustrated such on an inner side of the cover, the cover may be configured with engagement groves which are arranged to receive at least the first attachment member of the film member 18. As illustrated in FIGS. 3A and 3B the first attachment member 22 and the second attachment member 22' are configured as gripping elements and/or bends of the film, which are intended to be received in attachment structure on an inner side of the cover. The attachment structures of the inner side of the cover are not illustrated in more detail, but should be contemplated as being formed as grooves of recess corresponding to the bends of the first and second attachment structure of the film member 18.

The battery drawer 20 comprises a cover 16 having an inner structure 40 shaped to fit at least a portion of the outer structure of the battery 6. The inner structure 40 has a circular arced geometry configured to be brought into contact with the battery 6.

Furthermore, the cover 16 comprises a first plate-shaped engagement structure 30 and a second plate-shaped engagement structure 30' configured to be brought into engaging contact with the outer structures 31, 31' of the housing 4.

The longitudinal axis X and the lateral (transversal) axis Y of the battery drawer 20 are indicated in FIG. 3A. It can be seen that the first engagement structure 30 and the second engagement structure 30' are positioned in a distance from the outer structures 31, 31' of the housing 4. Accordingly, the cover 16 and thus the battery drawer 20 can be displaced along the lateral axis Y in order to bring the engagement structures 30, 30' into contact with the outer structures 31, 31' of the housing 4 as previously described in relation to FIGS. 3A and 3B.

Accordingly, FIG. 3B illustrates a schematic cross-sectional view of the hearing device 2 shown in FIG. 3A in a second configuration, in which the engagement structures 30, 30' have been brought into contact with the outer structures 31, 31' of the housing 4. It can be seen that the engagement structures 30, 30' bear against and thus abut the outer structures 31, 31' of the housing 4.

In an embodiment, shown in FIG. 3B, the battery drawer 20 has been brought into contact with an attachment member 34 of a contact structure 36 arranged in the housing of the hearing aid. The contact structure 36 has a geometry that corresponds to the geometry of the battery 6. The attachment member 34 may comprise a magnetic material (e.g. a permanent magnet) in order to provide an attraction force capable of keeping the battery drawer 20 in contact with the attachment member 34. The attachment member 34 may be attracted to the battery drawer 20 by means of magnetic attraction by applying an attachment member 34 that comprises a magnetic material (e.g. a permanent magnet). Alternatively, at least a section of the film member 18 may comprise a magnetizable or magnetic induced material, which connects with the contact structure 36. Hereby, it is possible to attach the film member 18 and thus the battery drawer 20 to internal structures of the housing by means of magnetic attraction. Accordingly, a firm attachment of the film member 18 to the housing can be achieved, ensuring that the battery drawer is kept in place in the housing structure.

Figure 4C:
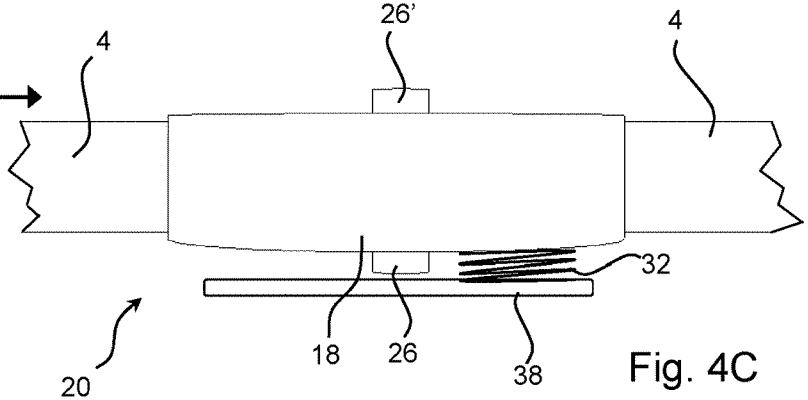
FIG. 4C shows a bottom view of the hearing aid shown in FIG. 4B.
Figure 4A:
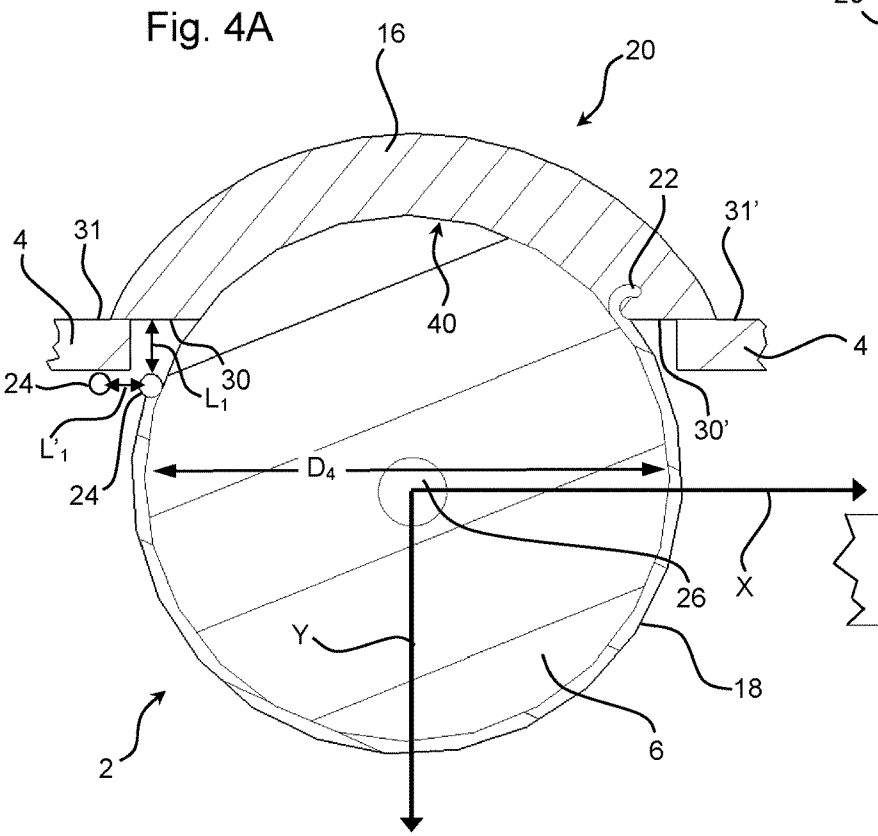
FIG. 4A shows a schematic cross-sectional view of an electrical device according to an embodiment of the disclosure.

FIG. 4A illustrates a schematic cross-sectional view of a hearing aid 2 in accordance with the previous figures. In this embodiment merely features which are not illustrated in the previous figures will be explained in more detail. Accordingly, it should be understood the previous numbers already given to embodiments of the drawings adheres to the figures according to FIGS. 4A and 4B, whereas additional features are given additional numbering.

As can be seen in FIG. 4A, the battery drawer may in an embodiment comprise third attachment member 24, which is arranged in the free end of the film member 18. The attachment member 24 may be magnetic in order to ease the fixation of the battery drawer to internal parts of the housing structure. The attachment member 24 is provided in a non-zero distance $L_1$ from the plate-shaped engagement structure 30 of the cover 16. As indicated, the attachment member 24 may also in an embodiment be provided in a non-zero distance $L'_1$ laterally from the periphery of the battery 6.

In a further embodiment, also illustrated in FIGS. 4A and 4B, an attachment structure 26 is arranged centrally with respect to the battery 6. The width $D_4$ of the battery is indicated in FIG. 4A.

The attachment structure 26 is illustrated in more detail in FIG. 4B, where a perspective bottom view of the hearing aid 2 shown in FIG. 4A is shown. It can be seen that an attachment structure 26' is attached to the film member 18. The attachment structure 26' is configured to be received by a corresponding receiving structure (not shown) in order to fix the battery drawer to the housing 4. The first attachment member 22 attached into a receiving structure provided in the cover 16 is also shown in FIG. 4B. Moreover, said previous mentioned attachment member 24 is attached to the free end of the film member 18 in order to enable a secure connection to the housing 4 as described above.

FIG. 4C illustrates a bottom view of the hearing aid shown in FIG. 4B. It can be seen that the hearing aid comprises a first attachment structure 26 and a second attachment structure 26' arranged on opposing sides of the film member 18. The attachment structures 26, 26' are basically cylindrical and protrude from the film member 18. Receiving structures (not shown) may be provided in the internal parts of the housing structure in order to lockingly receive the attachment structures 26, 26' of the film member. As previously described, two opposing plane surfaces of the battery is at least partly enclosed by opposing sides of the film member 18 as illustrated in the Figure. Furthermore, a cylindrical part of the film member covering the distance between the two opposing sides of the film member, surrounds at least a part of the cylindrical periphery of the battery. This serves to hold the battery substantially in place in the battery drawer.

A contact member 38 formed as a plate is provided next to the first attachment structure 26. A spring member 32 is arranged to provide a force towards the film member 18. Hereby, the spring member 32 can keep the battery inside the battery drawer 20 in place.

The cover 16 and thus the battery drawer 20 can be displaced along the lateral axis Y of the battery drawer 20 for bringing the engagement structures 30, 30' out of contact with the outer structures 31, 31' of the housing 4. In this way, the battery drawer 20 can be opened (removed) and closed (inserted) as previously described.

Figure 5B:
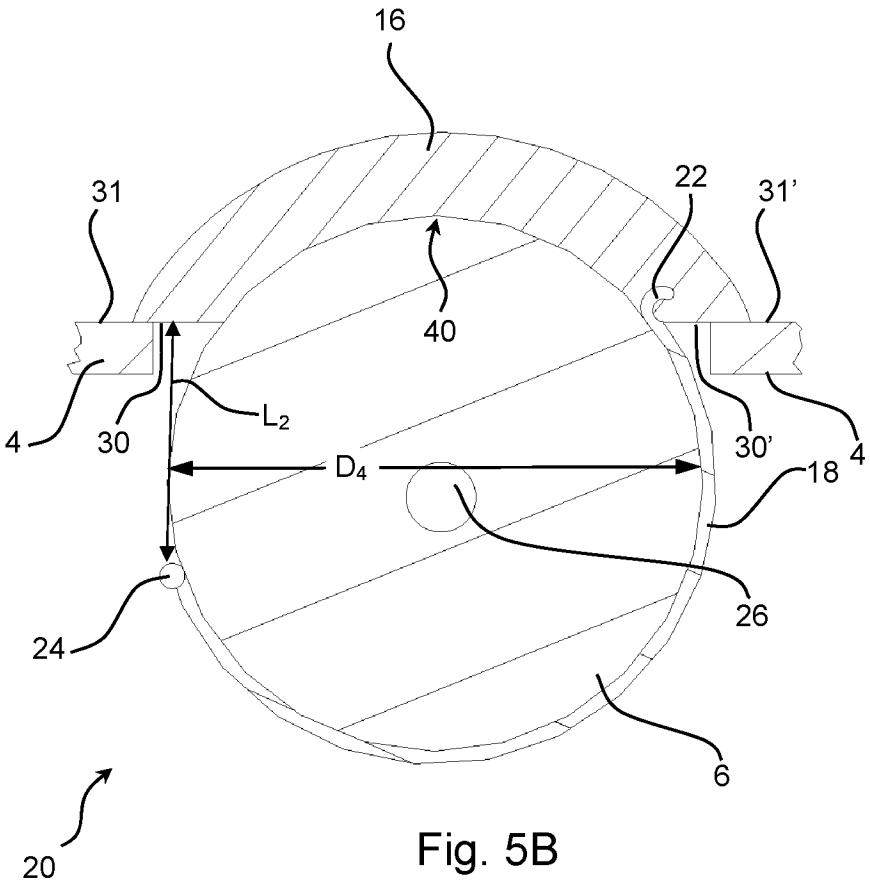
FIG. 5A shows a schematic cross-sectional top view of an electrical device according to an embodiment of the disclosure and FIG. 5B shows a cross-sectional view of the hearing aid shown in FIG. 5A.
Figure 5A:
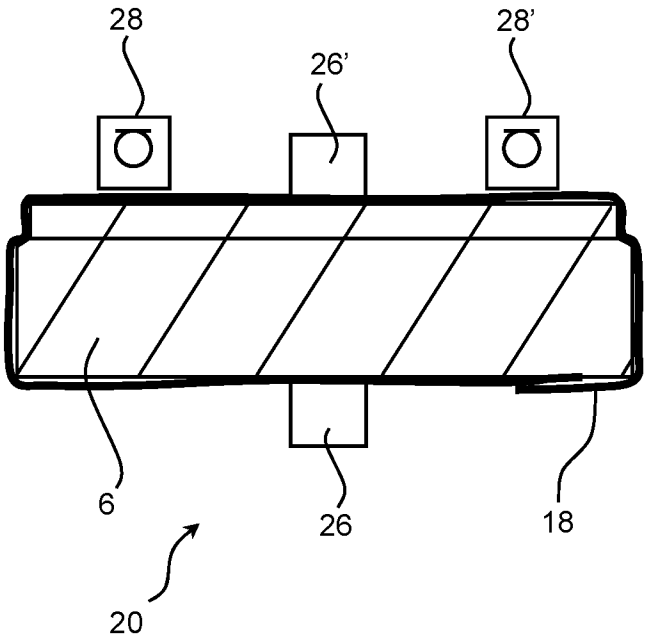

FIG. 5A illustrates a schematic cross-sectional top view of a hearing aid according to an embodiment of the disclosure. Similarly, to the previous embodiments described, the hearing aid comprises a battery drawer 20 having a film member 18 wrapped around a battery 6 received by the battery drawer 20. The film member 18 is made in a flexible material that allows the film member 18 to adapt to the shape of the battery 6.

Similarly, to the embodiments illustrated in FIGS. 4A to 4C, the battery drawer 20 comprises a first attachment structure 26 and a second attachment structure 26' arranged on opposing sides of the film member 18. The attachment structures 26, 26' are basically cylindrical and protrude from the film member 18. In addition, the embodiment illustrated how a first microphone 28 and a second microphone 28' are arranged next to the film member 18.

FIG. 5B illustrates a cross-sectional view of the hearing aid shown in FIG. 5A. The hearing aid 2 comprises a housing 4, a battery drawer 20 having a cover and a film member 18, wherein the film member 18 is configured as described in relation to FIG. 4A.

As previously described, the battery drawer 20 is provided with cover 16 comprising an inner structure 40 shaped to fit at least a portion of the outer structure of the battery 6, and further the cover is configured with a first plate-shaped engagement structure 30 and a second plate-shaped engagement structure 30' that are brought into engaging contact with the outer structures 31, 31' of the housing 4.

In the embodiment illustrated in FIG. 5B, the attachment member 24 is attached to the free end of the film member 18 and arranged in a distance from the inner structure of the cover. The attachment member 24 may be magnetic in order to ease a fixation of the attachment member 24 to the battery 6. Accordingly, in this embodiment the attachment member is configured to connect the film member 18 to the battery 6, so as to allow a common movement of the film member and the battery drawer when the cover is pulled away from or pushed into the hearing aid housing. The attachment member 24 is provided in a non-zero distance $L_2$ from the plate-shaped engagement structure 30 of the cover 16. An attachment structure 26 is arranged centrally with respect to the battery 6. The width $D_4$ of the battery is indicated in FIG. 4A.

Generally, for all of the embodiments, the film member 18 can be made of conducting or non-conducting material at least partly of fully as previously described.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. Accordingly, the scope should be judged in terms of the claims that follow.

The invention claimed is:

1. A hearing aid comprising a housing having an outer structure and a battery drawer configured to receive a battery and to be inserted into said housing from said outer structure, said battery drawer comprising a cover and a surrounding structure, wherein the surrounding structure is attached to the cover, said surrounding structure is configured to at least partly surround said battery, and said surrounding structure is configured as a film member made in a flexible and/or bendable material, wherein said battery drawer is configured to receive said battery in said surrounding structure, such that said battery drawer upon a user of the hearing aid gripping and pulling or pushing the cover, the battery drawer is configured to be inserted into or taken out from said housing, wherein the direction of insertion of said battery drawer is substantially perpendicular to a surface of said outer structure of said housing, wherein said film member comprises two opposing plane sides, which two opposing plane sides of the film member are configured to at least partly surround the battery on at least two opposing sides of said battery, said two opposing sides of the film member being distanced by a further cylindrical side configured to surround at least a part of the cylindrical periphery of said battery such that said film member receives said battery in a cavity formed by the two plane sides and said cylindrical side of said film member.

2. A hearing aid according to claim 1, wherein the cover comprises at least one engagement structure configured to be brought into contact with at least one structure of the housing, and wherein the surrounding structure is attached to the cover by means of a first attachment member and/or a second attachment member.

3. A hearing aid according to claim 2, wherein the at least one engagement structure of the cover is configured as a plate-shaped engagement structure, which upon insertion of said battery drawer is brought into engaging contact with said outer structure of the housing.

4. A hearing aid according to claim 3, wherein said at least one engagement structure of said cover is arranged on said cover in parallel with an outer surface of said housing structure, and where at least one inner side of said cover is configured with engagement groves arranged to receive at least a first attachment member of said film.

5. A hearing aid according to claim 3, wherein the cover comprises an inner structure shaped to fit at least a portion of the outer structure of the battery, wherein the surrounding structure extends from said cover around an outer contour of said battery.

6. A hearing aid according to claim 2, wherein said at least one engagement structure of said cover is arranged on said cover in parallel with an outer surface of said housing structure, and where at least one inner side of said cover is configured with engagement groves arranged to receive at least a first attachment member of said film.

7. A hearing aid according to claim 2, wherein the cover comprises an inner structure shaped to fit at least a portion of the outer structure of the battery, wherein the surrounding structure extends from said cover around an outer contour of said battery.

8. A hearing aid according to claim 1, wherein the cover comprises an inner structure shaped to fit at least a portion of the outer structure of the battery, wherein the surrounding structure extends from said cover around an outer contour of said battery.

9. A hearing aid according to claim 1, wherein the surrounding structure is at least partly connected to the housing and/or to a structure arranged in the housing by means of a third attachment member, said third attachment member being configured as a magnetic element arranged in a free end of said surrounding structure.

10. A hearing aid according to claim 9, wherein the third attachment member is arranged in a non-zero distance from the cover.

11. A hearing aid according to claim 10, wherein the third attachment member is arranged in a non-zero distance along a longitudinal axis (X) of said cover or of a transverse direction (Y) perpendicular to said longitudinal axis (X) from said cover.

12. A hearing aid according to claim 1, wherein the thickness of the surrounding structure is 0-300 μm.

13. A hearing aid according to claim 1, wherein the width of the battery drawer corresponds to the sum of the diameter of the battery and two times the thickness of the surrounding structure.

14. A hearing aid according to claim 1, wherein the battery drawer comprises a spring member or a resilient member configured to press against the battery, when the battery is arranged in the battery drawer, wherein the spring member or the resilient member is configured to maintain the battery in a fixed position with respect to the battery drawer.

15. A hearing aid according to claim 1, wherein the battery drawer is attached to the housing without using a hinge.

16. A hearing aid according to claim 1, wherein at least a section of the surrounding structure comprises a magnetic material such that said section is removably attachable to a corresponding section of the housing by means of magnetic attraction.

17. A hearing aid according to claim 1, wherein the film member comprises an attachment structure configured to be received by a corresponding receiving structure in said housing, wherein the attachment structure is protruding from a plane side of said film member.

18. A hearing aid comprising:

a housing having an outer structure and a battery drawer configured to receive a battery and to be inserted into said housing from said outer structure, said battery drawer comprising a cover and a surrounding structure, wherein one end of the surrounding structure is attached to the cover, said surrounding structure is configured to at least partly surround said battery, and said surrounding structure is configured as a film member made in a flexible and/or bendable material, wherein said battery drawer is configured to receive said battery in said surrounding structure, such that said battery drawer upon a user of the hearing aid gripping and pulling or pushing the cover, the battery drawer is configured to be inserted into or taken out from said housing, wherein the direction of insertion of said battery drawer is substantially perpendicular to said surface of said outer structure of said housing, wherein the surrounding structure is removably attached to the housing, and/or to a structure affixed to the housing, by means of an attachment member configured as a magnetic element arranged in a free end of said surrounding structure.

19. A hearing aid according to claim 18, wherein the cover comprises at least one engagement structure configured to be brought into contact with at least one structure of the housing, and wherein the surrounding structure is attached to the cover by means of a first attachment member and/or a second attachment member.

20. A hearing aid according to claim 18, wherein the cover comprises an inner structure shaped to fit at least a portion of the outer structure of the battery, wherein the surrounding structure extends from said cover around an outer contour of said battery.

21. A hearing aid comprising a housing having an outer structure and a battery drawer configured to receive a battery and to be inserted into said housing from said outer structure, said battery drawer comprising a cover and a surrounding structure, wherein the surrounding structure is attached to the cover, said surrounding structure is configured to at least partly surround said battery, and said surrounding structure is configured as a film member made in a flexible and/or bendable material, wherein said battery drawer is configured to receive said battery in said surrounding structure, such that said battery drawer upon a user of the hearing aid gripping and pulling or pushing the cover, the battery drawer is configured to be inserted into or taken out from said housing, wherein the direction of insertion of said battery drawer is substantially perpendicular to said surface of said outer structure of said housing, and wherein at least a section of the surrounding structure comprises a magnetic material such that said section is removably attachable to a corresponding section of the housing by means of magnetic attraction.

* * * * *